US005246605A

United States Patent [19]

Vartanian

[11] Patent Number: 5,246,605

[45] Date of Patent: Sep. 21, 1993

[54] POLYUREA-BASED GREASE WITH METAL BORATE AND ANTIMONY ADDITIVES

[75] Inventor: Paul F. Vartanian, Oakland, Calif.

[73] Assignee: Chevron Research Company, San Francisco, Calif.

[21] Appl. No.: 966,255

[22] Filed: Oct. 26, 1992

Related U.S. Application Data

[63] Continuation of Ser. No. 815,689, Jan. 2, 1986, abandoned, which is a continuation of Ser. No. 665,802, Oct. 29, 1984, abandoned.

[51] Int. Cl.[5] ..... C10M 123/00

[52] U.S. Cl. ..... 252/25; 252/32.5; 252/32.7 E; 252/33.6; 252/45

[58] Field of Search ..... 252/18, 25, 33.6, 33, 252/45, 49.6, 32.5, 32.7 E, 51.5 A

[56] References Cited

U.S. PATENT DOCUMENTS

| | | | |
|---|---|---|---|
| 3,139,405 | 6/1964 | Farmer et al. | 252/33.6 |
| 3,516,922 | 6/1970 | Anzilotti et al. | 208/47 |
| 4,100,081 | 7/1978 | Dreher et al. | 252/25 |
| 4,155,858 | 5/1979 | Adams | 252/18 |
| 4,200,543 | 4/1980 | Liston et al. | 252/32.7 E |

FOREIGN PATENT DOCUMENTS

| | | |
|---|---|---|
| 59-109595 | 6/1984 | Japan . |

*Primary Examiner*—Jacqueline V. Howard
*Attorney, Agent, or Firm*—J. J. DeYoung; W. K. Turner

[57] ABSTRACT

Disclosed is a grease composition comprising a major amount of a lubricating oil base vehicle, a polyurea gellant in an amount sufficient to thicken the base vehicle to grease consistency, an alkali-metal borate in an amount sufficient to impart extreme-pressure properties to the grease and from 0.1 to 10.0 mass percent of antimony dithiocarbamate.

5 Claims, No Drawings

POLYUREA-BASED GREASE WITH METAL BORATE AND ANTIMONY ADDITIVES

This is a continuation of application Ser. No. 815,689, filed Jan. 2, 1986 which is a continuation of Ser. No. 665,802, filed Oct. 29, 1984 both now abandoned.

BACKGROUND OF THE INVENTION

This application is concerned with improved polyurea-thickened greases containing alkali-metal borate extreme-pressure agents and antimony compound containing agents which further improve the properties of the grease.

Modern technology is currently supplying the general public with machinery which is designed to operate under a wider range of temperatures and under greater loads than previously available. In addition, many of the newer machines are designed to operated at extremely high speeds. Many of these machines require certain specific lubrication properties which are not available in conventional lubricants.

in the past various agents have been employed to improve the antiwear and extreme pressure properties of greases. However, while improving the extreme pressure properties of the grease many of these agents have adversely increased the corrosiveness of the grease to the metal parts which the grease is intended to protect.

Alkali-metal borate containing agents are well known in the art for their usefulness as extreme pressure agents in greases. See, for example, U S. Pat. Nos. 4,155,858 4,100,080 and 4,100,081.

SUMMARY OF THE INVENTION

Disclosed is a grease composition comprising a major amount of a lubricating oil base vehicle, a polyurea gellant in an amount sufficient to thicken the base vehicle to grease consistency, an alkali-metal borate in an amount sufficient to impart extreme-pressure properties to the grease and from 0.1 to 10.0 mass percent of antimony dithiocarbamate.

DETAILED DESCRIPTION OF THE INVENTION

The present invention is an improvement over the invention disclosed in the aforementioned U.S. Pat. No. 4,100,081, the entire disclosure of which is incorporated herein by reference. It has been found that by incorporating an antimony dithiocarbamate into a polyurea-thickened borate-containing grease that the extreme pressure and antiwear properties of the grease are surprisingly improved. It is believed that the antimony dithiocarbamate additive and the alkali-metal borate additive interact in a synergistic manner to provide the improved extreme pressure and antiwear properties of the grease.

The grease composition of the present comprises the combination of at least four components: (1) a lubricating oil base vehicle, (2) a polyurea gellant(thickener), (3) an alkali-metal borate additive and (4) an antimony dithiocarbamate additive.

The lubricating oil base vehicle and the polyurea gellant are well known in the art. Any lubricating oil base vehicle commonly used in greases can be used. Generally, the base vehicle will comprise 51 to 98 mass percent of the final grease composition and more commonly 75 to 95 mass percent of the final grease composition. The base vehicles are most commonly petroleum oils or synthetic base oils.

The polyurea gellant component for use in the present combination is also well known in the grease art and may be prepared by conventional means. For example, U.S. Pat. No. 3,242,210 describes the preparation of polyurea-thickened greases suitable for use in the combination of the present invention, and its disclosure is incorporated herein by reference. The polyurea is used in an amount sufficient to thicken the base vehicle to grease consistency. The greases of the present invention will generally have a consistency of NLGI No. 4 to NLGI No. 000. NLGI stands for National Lubricating Grease Institute. Generally the amount of the thickener will be in the range of 3 to 15 mass percent of the final composition. Generally smaller amounts of thickener are required for greases of softer consistency.

Alkali-Metal Borate Additive

The alkali-metal borates are well known in the art and are available commercially. Representative patents disclosing suitable borates and methods of manufacture include U.S. Pat. Nos.: 3,313,727: 3,819,521; 3,853,772; 3,907,601; 3,997,454; and 4,089,790, the disclosures of which are incorporated herein by reference. Preferred are the hydrated potassium borates. Particularly preferred are the hydrated potassium triborate microparticles having a boron-to-potassium ratio of about 2.5 to 4.5. The borate particles generally have a mean particle size of 1 micron.

The alkali-metal borate additive is added to the grease in an amount sufficient to impart extreme-pressure properties to the grease. The borate will generally comprise 0.1 to 10 and more preferably 1 to 5 mass percent of the final grease composition.

Antimony Dithiocarbamate Additive

The antimony dithiocarbamate additives are also well known in the art and are available commercially. Preferred are the oil-soluble antimony dithiocarbamates having 1 to 50 carbon atoms and more preferably the oil-soluble antimony dialkyldithiocarbamates having 1 to 24, preferably 3 to 10, carbon atoms in the alkyl group. Representative alkyl groups for the antimony dialkyldithiocarbamates include: methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, octadecyl, nonadecyl, eicosyl, etc. Preferred is dipentyldithiocarbamate.

The antimony dithiocarbamate additive is added to the grease in an amount sufficient to impart added extreme-pressure and antiwear properties to the grease above that provided by the borate additive described above. The antimony dithiocarbamate will generally comprise 0.1 to 10.0 and more preferably 0.25 to 2 mass percent of the final grease composition.

It is believed that the antimony dithiocarbamate additive and the alkali-metal borate additive interact in a synergistic manner to provide the improved extreme pressure and antiwear properties of the grease of the present invention.

Other Additives

The grease composition may contain other additives, if desired, for the particular service intended. Other additives that may commonly be used include: rust inhibitors, corrosion inhibitors, metal deactivators, viscosity index improvers, antioxidants, and other additives recognized in the art to perform a particular function or functions.

A particularly preferred additional additive for use in the present invention is the oil-soluble amine salt of a phosphorus compound, i.e., the phosphate and/or monthiophosphate. Preferred are the salts of a mixture of dibutylthiophosphate and dibutylphosphate. Particularly preferred is the oleylamine salt of a mixture of dibutylthiophosphate and dibutylphosphate. Another preferred additional additive is sulfurized olefins particularly the sulfurized polybutenes. These two additional additives will generally each be present in minor amounts of from 0.25 to 2.5 mass percent of the final grease composition. The corrosiveness of the grease of the present invention is also surprisingly low with these two additional additives as compared to grease containing larger amounts of the amine salts and sulfurized hydrocarbons.

The following tests illustrate one or more embodiments of the present invention in comparison to greases not embodied in the claims of the present invention. It is to be understood, however, that these embodiments are presented for illustrative purposes only and that the invention in it broader aspects should not be limited thereto.

EXAMPLES

A series of tests were performed on various test sample compositions to measure the extreme pressure properties of the grease using the Timken EP test. The Timken test is a well-known standardized test and is described in ASTM-D 2509, which test procedure is incorporated herein by reference. The Timken test measures the load (between 0 and 100 pounds) at which the rupture of a film of the grease between the rotating cup and a stationary block takes place. The surface distress (e.g., scoring, abrasion) of the stationary block is measured. Thus, the higher the load, the better the load-carrying properties cf the grease. In these tests, the base oil is a mixture of paraffinic and naphthenic mineral oils containing a polyurea thickener made from toluene diisocyanate, ethylene diamine, and oleylamine as described in U.S. Pat. No. 3,920,571.

Additive A consisted of 45 weight percent of a low viscosity base oil, 5 weight percent of a calcium sulfonate dispersant, 10 weight percent of a polyalkylaminoimide of an alkylsuccinic acid, and 40 weight percent of a potassium triborate.

Additive B consisted of an antimony dialkyldithiocarbamate obtained from the R.T. Vanderbilt Company and known as Vanlube 73. From laboratory analysis Vanlube 73 is believed to consist of antimony dipentyldithiocarbamate.

The test results are shown below in Table I.

TABLE I

| Test | Additive and (Concentration) | Timken OK Load, lbs. |
|---|---|---|
| 1 | none | 15 |
| 2 | A(5%) | 30 |
| 3 | B(1%) | 15 |
| 4 | A(4%) + B(1%) | 45 |

Comparison of Examples 1 through 4 indicates that the alkali-metal borate additive and the antimony dithiocarbamate additive interact in a synergistic manner to provide an increase in the extreme pressure properties of the polyurea-based grease.

What is claimed is:

1. A grease composition comprising a major amount of a lubricating oil base vehicle, a polyurea gellant in an amount sufficient to thicken the base vehicle to grease consistency, and 4 mass percent alkali-metal borate and 1 mass percent antimony dipentyldithiocarbamate.

2. The grease composition of claim 1 wherein said grease also contains 0.25 and 2.5 mass percent of an amine salt of a phosphorous compound.

3. The grease composition of claim 2 wherein said salt is a mixture of dibutylthiophosphate and dibutylphosphate.

4. The grease composition of claim 1 wherein said grease also contains 0.25 to 2 mass percent of a sulfurized polybutene.

5. The grease composition of claim 1 wherein said grease also contains 0.25 to 2.5 mass percent of an amine salt of a mixture of dibutylthiophosphate and dibutylphosphate and 0.25 to 2.5 mass percent of a sulfurized polybutene.

* * * * *